US005813571A

United States Patent [19]

Gaucher

[11] Patent Number: 5,813,571

[45] Date of Patent: Sep. 29, 1998

[54] DEVICE FOR PACKAGING A PRODUCT WITH A SUPPORT RING FOR A MANUAL PUMP FOR DISPENSING IN INDIVIDUAL METERED AMOUNTS

[75] Inventor: Denis Gaucher, Annecy, France

[73] Assignee: Societe d'Innovation Recherche Plastique, France

[21] Appl. No.: 730,186

[22] Filed: Oct. 15, 1996

[30] Foreign Application Priority Data

Oct. 19, 1995 [FR] France ..... 95 12300

[51] Int. Cl.[6] ..... B65D 35/28

[52] U.S. Cl. ..... 222/95; 222/105; 222/321.7

[58] Field of Search ..... 222/321.7, 321.1, 222/95, 105, 321.9, 386.5, 340

[56] References Cited

U.S. PATENT DOCUMENTS 4,435,135 3/1984 Knickerbocker ..... 417/511
4,969,577 11/1990 Werding ..... 222/94
5,100,027 3/1992 Gueret .
5,292,033 3/1994 Gueret .
5,630,531 5/1997 Gaucher ..... 222/96

*Primary Examiner*—Andres Kashnikow
*Assistant Examiner*—David Deal
*Attorney, Agent, or Firm*—Henderson & Sturm

[57] ABSTRACT

The flexible inner pouch is fixed in a leaktight manner by its neck to a rigid ring having peripheral means for fastening on the neck of a rigid bottle accommodating the flexible pouch and an inner tubular part with means for fastening on a central tubular part of a pump body, a seal ensuring leaktightness between the two tubular parts, independently of the means for fastening the pump on the ring. A circuit for air intake into the volume between the pouch and the bottle may comprise an air passage formed in the pump body and closed by confinement means when the pump is not actuated by operating a plunger.

11 Claims, 3 Drawing Sheets

Figure 1:
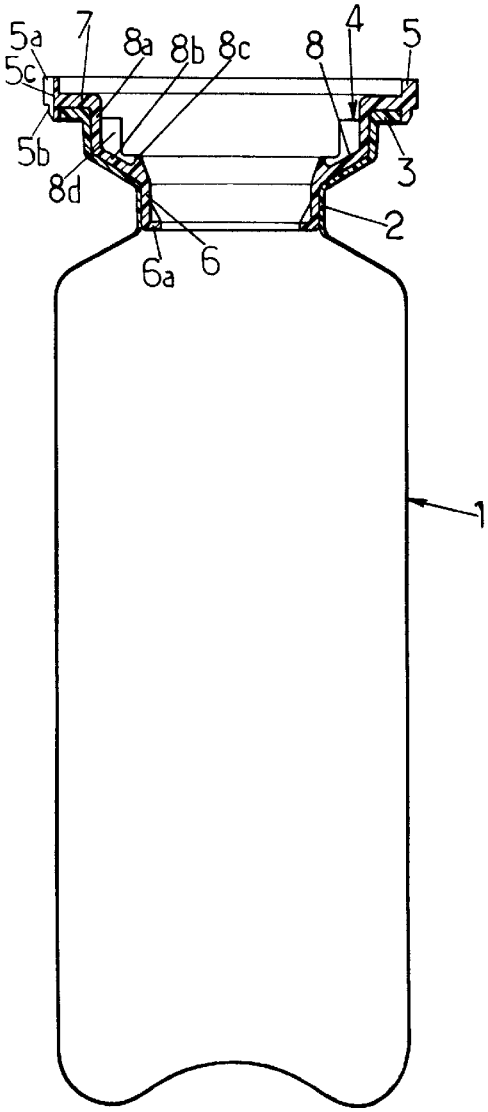

DEVICE FOR PACKAGING A PRODUCT WITH A SUPPORT RING FOR A MANUAL PUMP FOR DISPENSING IN INDIVIDUAL METERED AMOUNTS

The invention relates to the technical field of packaging a product intended to be distributed in individual metered amounts with the aid of a manual pump.

The subject of the invention is more precisely a device for packaging and dispensing a product comprising a rigid outer container with an open neck, a deformable inner container with an open neck, this inner container being essentially accommodated inside the outer container and intended to contain the product to be packaged and dispensed, and a manual pump, of the type without air intake into the inner container, this pump being intended to dispense the product in individual metered amounts and being mounted in a leaktight manner on the neck of the inner container with the aid of leaktight means.

Packaging devices of more conventional structure are known, these comprising a single container on which a manual pump for dispensing the product contained in the container is fitted. A pump of this type generally includes a plunger making it possible through pressure from the user's finger, to displace a piston in a pumping chamber, the volume of which determines the metered amount to be dispensed. A first valve, which is closed, isolates this chamber from the internal volume of the container, when this product is expelled from this chamber via a second valve, which is open, through the effect of the displacement of the piston by pressure on the plunger. The second valve then closes and isolates the chamber from the outside, when this chamber is filled via the first valve, which is open, with a metered amount of product originating from the container and sucked into the chamber by means of the return of the piston towards its initial position, bearing against a stop of a pump body in which the piston slides, and through the action of elastic return means.

Therefore, each time the piston returns to its initial position, through the effect of the elastic return means, and after a metered amount of product has been dispensed, a new metered amount of product is sucked into the chamber of the pump.

This suction of the product gives rise to a reduced pressure inside the container.

In order to prevent intake of outside air into the container in order to compensate for this reduced pressure, packaging and dispensing devices have been proposed, of the type mentioned above to which the invention relates, which include a deformable internal container, containing the products to be packaged and dispensed and arranged in a rigid outer container, as well as a pump without air intake. Each time a metered amount of product is expelled from the deformable container, the reduced pressure created contracts the latter, around which the rigid outer container affords mechanical protection for the inner container. However, for a device of this type to operate, it is necessary for the deformable inner container to be able to retract.

For this reason, it is necessary to allow outside air to enter the volume delimited between the two containers.

This intake of air is generally ensured by at least one passage in the bottom of the rigid container, but the intake of air may also be produced in the vicinity of the neck of this rigid container.

A major drawback of this type of packaging device lies in the fact that the deformable inner container, generally made of plastic, must have a thin wall thickness in order to be able to deform easily, and in the fact that this results in considerable permeability of its wall, and migration of a part of the product and/or evaporation of at least one volatile component of the product to be dispensed, through this thin flexible wall of the deformable container.

This phenomenon may be observed particularly with aqueous or alcoholic products and/or with those containing one or more volatile substances.

A gas released by the packaged product or a vapour resulting from the evaporation of a volatile phase of this product can pass through the thin wall of the deformable container and escape towards the outside via the passage reserved for the air intake.

In order to remedy this drawback, deformable containers made from relatively impermeable flexible composites have been proposed.

However, these materials have the disadvantages of being expensive and difficult to employ. Moreover, they are never totally impermeable and migration and/or evaporation is always noted after a reasonably long period of packaging.

A further solution to this problem already proposed consists in providing a non-return or one-way valve placed in the passage or downstream of the passage provided for the air intake.

A valve of this type allows air to enter the volume between the two containers, when the suction due to the return of the pump piston towards its rest position requires it, but prevents leakage towards the outside of gas and/or vapour, the presence of which in the volume between the two containers is the result of evaporation and of the passage of volatile phase(s) of the product contained in the deformable container through the thin wall of this container. Thus, evaporation of the product and its migration towards the volume contained between the two containers cease as soon as this volume reaches saturation.

However, employing non-return valves of this type requires the manufacture and mounting of at least one additional piece in order to produce this valve, which considerably increases the cost of the device.

Furthermore, another major drawback of this type of packaging device, with or without an impermeable flexible container, non-return valve and intake of air in the bottom of the rigid container or at its neck, lies in the complexity of its structure, and therefore its manufacturing cost, especially if the pump should be mechanically fastened securely onto the two containers without compromising the reliability and durability of the leaktightness which is to be produced between the pump and the flexible container, while being capable of withstanding the reduced pressures created in the flexible container during use.

The main object of the invention is to produce a device of the aforementioned type, for which there is no risk of release or any other malfunction of the means for fastening the pump on the containers, or of concomitant or independent degradation of the leaktightness between the pump and the internal container, while giving the device a simple structure which is economic to manufacture.

A second object of the invention is to remedy a drawback mentioned above, by proposing a packaging and dispensing device structure which does not require additional pieces for making a non-return valve allowing intake of outside air into the volume between the two containers and preventing leakage of gas or vapour from this volume.

With the aim of achieving the main object of the invention, the invention proposes a device for packaging and dispensing a product, which is of the type presented above and which is characterized in that the pump includes a body having a tubular part which is surrounded by the said leaktight means and is engaged in a leaktight manner in the neck of the inner container, for feeding the pump with product from the inner container, and the neck of the inner container is secured in a leaktight manner to a rigid annular ring, provided, at its outer periphery, with first fastening means, which interact with complementary fastening means of the neck of the outer container, for fastening the inner container and the ring on the outer container and, at its inner periphery, with second fastening means, which interact with complementary fastening means of the pump body, for fastening the pump to the ring, the said tubular part of the said pump body being engaged in the said ring and the said leaktight means comprising at least one annular gasket, mounted between the said ring and the said tubular part of the pump body while being separated from the said second fastening means of the ring and from the said complementary fastening means of the said pump body.

By virtue of the use of the intermediate ring between, on the one hand, the inner container and, on the other hand, the outer container and the pump, it is possible to ensure not only excellent fastening of the assembly consisting of the ring and the inner container in the outer container, but also of the pump on the rigid outer container, by means of the ring, and furthermore, between the pump body and the ring, excellent leaktightness which can withstand the reduced pressures created in the inner container during use. This embodiment has the advantage of avoiding any interference in operation between the means for fastening the pump on the containers and the leaktight means between the pump and the inner container.

Advantageously, in order to allow quick assembly, using moulded plastic pieces of simple shapes, of the ring/inner container assembly on the outer container and of the pump on the ring, the said first and second fastening means of the ring and the said complementary fastening means of the neck of the outer container and of the pump body are removable elastic snap-fastening means, with outer radial projections moved axially beyond facing inner radial projections in order to fix the ring on the outer container and the pump body on the ring.

Advantageously, the said ring comprises, at its inner periphery, an inner tubular part which has the said second fastening means and in which the said tubular part of the pump body is engaged, which tubular part has the said complementary fastening means, the said annular gasket being mounted between the said inner tubular part of the ring and the said tubular part of the pump body, so that the gasket can move axially between the said tubular parts without this impairing the leaktightness which it ensures. The attachment of the pump on the intermediate ring thus has no effect on the leaktightness, and vice versa.

In order to allow the ring to be attached onto the neck of the outer container after the inner container and the ring have been introduced into the outer container, the ring advantageously comprises, at its outer periphery, an outer tubular part which has the said first fastening means and is engaged in the said neck of the outer container, the complementary fastening means of which are provided with projections and/or hollows having complementary shapes for coupling to the said first fastening means of the ring.

The second object of the invention, namely the admission of outside air into the volume between the containers, without a non-return valve, and while preventing leakage from this volume of any gas or vapour originating from the packaged product and having migrated through the wall of the inner container, is achieved in that the outer container has a closed bottom and at least one of the said ring and the said necks defines at least partially, outside the said leaktight means, at least a first passage for air intake into the volume defined between the two containers and the body of the pump has, also outside the said leaktight means, at least a second passage for air intake into the said volume between the containers so that the said first and second passages for air intake define in succession a conduit permitting the intake of external air into the volume between the containers, at least when the pump is actuated, and the device also comprises means for confining any part of the product passing through the deformable wall of the inner container from the internal volume of the latter towards the volume between the containers and tending to escape towards the outside via the conduit for air intake, at least when the pump is not actuated.

Thus, the air can pass through these successive passages and compensate the reduced pressure created between the deformable container and the protective rigid container when the user operates the pump. However, the gas or gases and/or vapour(s) resulting from evaporation of the product located in the deformable container and which has/have passed through the wall of the latter cannot escape by using these successive passages because its/their route will be blocked by the confinement means.

In a first advantageously simple embodiment, the first passage for air intake is formed, between the outer periphery of the ring and the neck of the outer container, by the said first fastening means of the ring and the said complementary fastening means of the neck of the outer container, and with the aid of at least one recess formed in the said ring and/or in the said neck of the outer container. This embodiment avoids having to form orifices in the thickness of the neck of the outer container, in the thickness of the ring and/or in the neck of the inner container. Furthermore, the fact that a first passage of this type is in permanent communication with a second passage, which is always open towards the outside of the pump, achieves the effect that the conduit for air intake is permanently open, and the confinement means may comprise a leaktight cap fastened removably and in a leaktight manner on the device, around the pump and the necks of the containers, and the conduit for air intake opens out inside the cap when the latter is fastened on the device.

In this embodiment, the confinement is therefore provided by a cap, which a device of this type generally includes, so that no additional piece is necessary.

When the device is equipped with a pump of the type comprising a piston, applied against a stop of the pump body by means for elastic return to the rest position of the pump and separated from the stop against the elastic return means by manual pressure by the user on a plunger when the pump is actuated, it is then advantageous for the said passages for air intake to be in permanent communication with one another, and for the confinement means to comprise the said stop which has an annular part, forming a leaktight seat, in contact with an annular part of the piston and which allows air to pass from the outside of the device towards the said passages for air intake as soon as the said annular part of the piston is separated from the said annular part of the stop by manual pressure on the said plunger.

In this variant, it is insufficient to remove the removable cap, generally provided on this type of device, in order to admit air into the volume between the containers, but the pump must be actuated. Moreover, for as long as it is not actuated, and even if the cap is removed, the confinement of the vapours and gases originating from the product in the inner container, which have been able to cross into the volume between the two containers, is provided by the interaction of the stop with the piston, in the rest position.

In an advantageous embodiment of the passage for air intake of the pump body, the stop of the pump body is secured to a tubular inner jacket of the pump body and projects towards the interior of the said inner jacket which surrounds a cylinder of the pump body in which the said piston is mounted so as to slide in a leaktight manner, the said second passage for air intake comprising at least one channel delimited between, on the one hand, the said cylinder and, on the other hand, the said inner jacket and the said stop, one end of the said channel opening towards the outside of the said pump body, between the said stop and the said piston, as soon as the piston is separated from the stop by manual pressure on the plunger, while the other end of the said channel permanently opens into an annular space delimited between the pump body and the ring, and itself in permanent communication with the said first passage for air intake.

Since the volume located between the two containers is extended by a closed space delimited by the interaction of the pump piston and its stop, and only external air can enter this volume between the containers, while no gas and no vapour can leak therefrom towards the outside, it is furthermore advantageous for this volume between the containers to contain at least one chemical substance or a substance capable of binding a gas and/or a vapour contained in the outside air admitted into this volume, in order to prevent this gas or this vapour from diffusing through the wall of the inner container and towards the product in the internal volume of the latter. By way of example, this chemical substance may bind the oxygen in the air or the water vapour contained in the outside air, the diffusion of which towards the inside of the deformable container, through the wall of the latter, would have the effect of degrading products sensitive to oxidation or moisture.

Whether or not the device has passages for air intake and confinement means, as presented above, it is furthermore advantageous, in order to facilitate mounting of the pump on the outer container, mounting of the plunger on the pump body and operating of the pump, for the body to comprise an outer tubular jacket, surrounding the said cylinder and inner jacket and delimiting with them, on the pump body, an annular chamber for accommodating and supporting an end part of at least one coil spring for compressing the said elastic return means, the other end part of which is accommodated inside a first tubular skirt, secured to the pump plunger and having its free end engaged in the said annular chamber of the pump body, the said outer jacket being itself surrounded by a second tubular skirt, secured to the pump body and fitted into the neck of the outer container.

Production of the pump is furthermore facilitated if, in addition, the tubular part of the pump body substantially extends the cylinder of the said body and is secured to a bottom at one end of the cylinder which is turned towards the inner container, the said bottom being pierced by at least one orifice for filling the cylinder with product originating from the inner container and supporting at least one valve for intake into the pump, which valve is intended selectively to close and release the said filling orifice, the said piston of the pump being annular and extended, beyond the other end of the cylinder of the body, by a shaft which is mounted so as to slide in the said annular stop of the body and in which a dispensing tube of the said plunger is mounted so as to slide over a limited travel, the said tube being linked in translation with a tubular rod, of which it extends the central channel and which slides in a leaktight manner in the said shaft and is closed, in the annular piston, by a valve for outlet from the pump, which valve is applied in a leaktight manner against the annular plunger by the action of the elastic return means and is separated from the piston by acting on the plunger, in order to allow outlet of the product between the piston and the outlet valve, from the inside of the cylinder towards the inside of the tubular rod, via at least one radial orifice of the rod.

Figure 3:
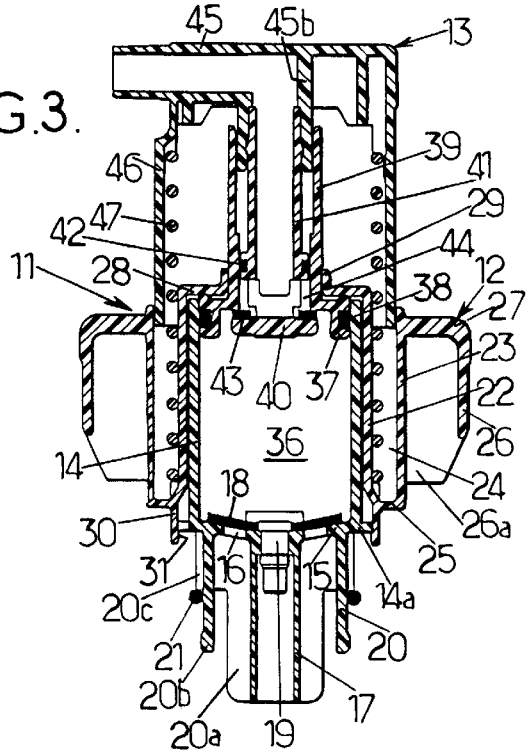
Figure 2:
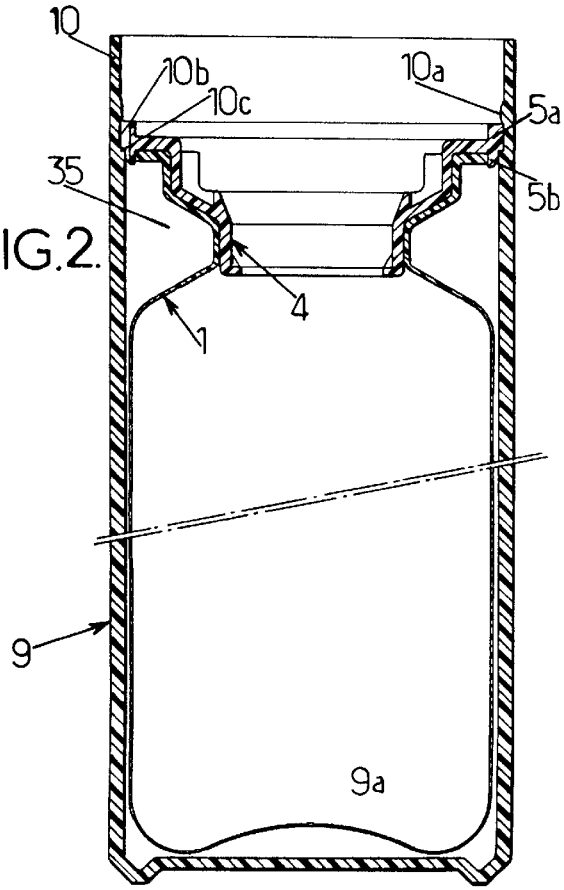
Figure 4:
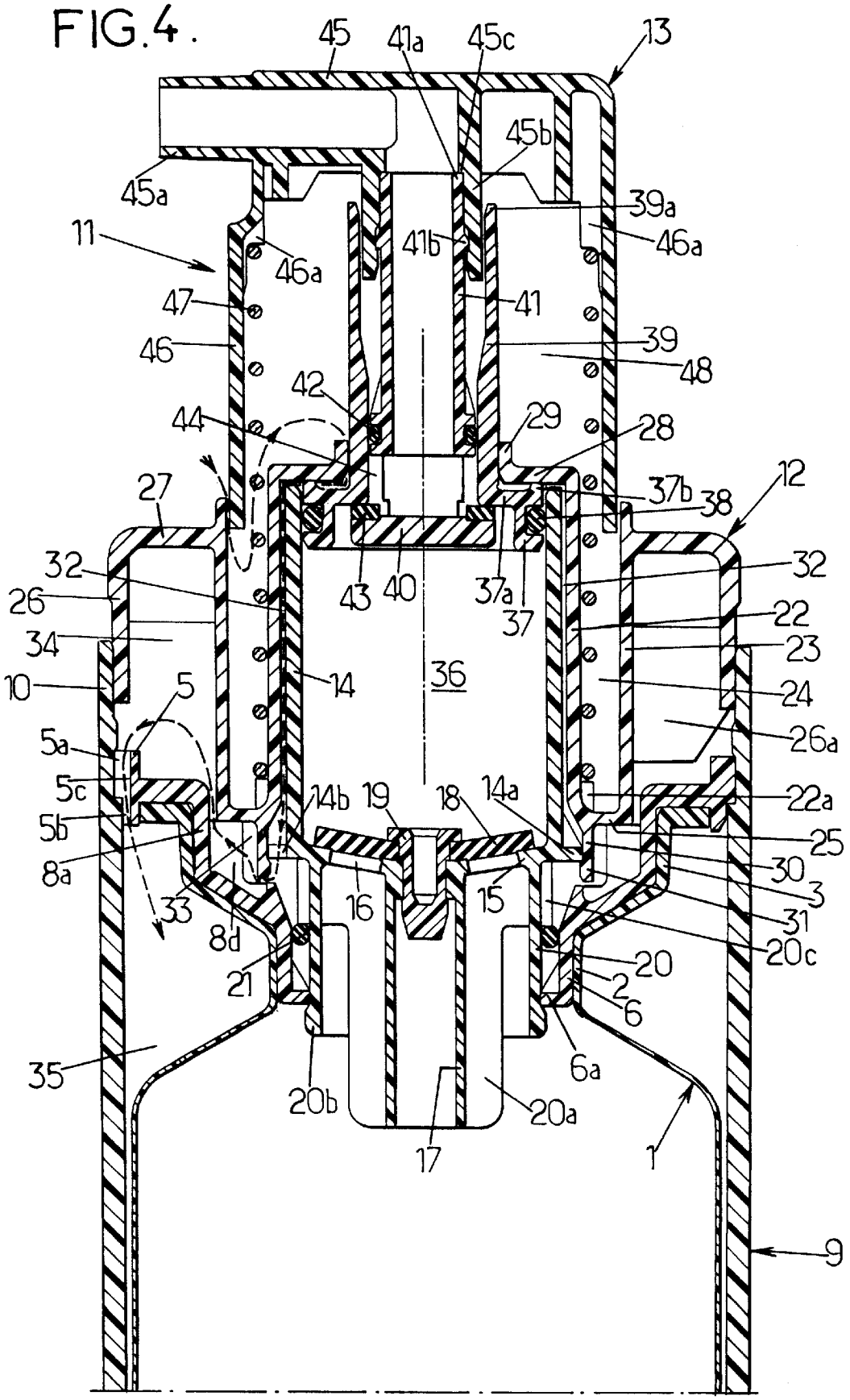

Further characteristics and advantages of the invention emerge from the description given below, with reference to the appended drawings which represent, by way of non-limiting examples, embodiments and forms of implementation of the subject of the invention. In these drawings:

FIG. 1 is a diagrammatic view in axial section of an assembly including a deformable inner container and a rigid ring, for one example of a device according to the invention, FIG. 2 is a view in axial section representing the assembly in FIG. 1, when mounted in a rigid outer container for protecting the device, FIG. 3 is a similar sectional view of the manual pump for dispensing in metered individual amounts the product contained in the inner container of the device, FIG. 4 is a view in axial section on an enlarged scale of the pump in FIG. 3 and mounted on the assembly in FIG. 2, and FIGS. 5 to 7 are diagrammatic views in axial section of the device in FIG. 4, respectively in the positions for storage, expulsion of a metered amount of product and filling the metering chamber of the pump.

In the various figures, similar elements have been given the same reference numbers.

As represented in FIG. 1, the packaging and dispensing device comprises a deformable inner container 1, also referred to as a flexible pouch, of which the essentially cylindrical body with a closed and concave bottom includes a thin flexible plastic wall which opens towards the outside in a neck 2 which is narrower than its body and is provided with an outwardly flared rim 3 whose thickness increases progressively to its outer radial periphery. By means of the open neck 2 and its flared rim 3, the pouch 1 is secured in a leaktight manner to the outer face of a rigid annular ring 4, moulded in a single piece using plastic and having, between two tubular parts, an outer one 5 and an inner one 6, respectively at its outer and inner peripheries, a radial annular collar 7 and a cylindro-conical central part 8, with an axially projecting annular rib 8*c* which is chamfered towards the interior of the inner tubular part 6, in its frustoconical portion 8*b*, and stop ribs 8*d* axially projecting in its cylindrical 8*a* and frustoconical 8*b* portions, for positioning the pump body as described below. For fastening to the latter, the lower end (towards the inside of the pouch 1) of the inner tubular part 6 has an annular step 6*a* projecting radially inwards, while for fastening the ring 4 in an outer container, as described below with reference to FIG. 2, the upper region 5*a* of the outer tubular part 5 projects radially outwards relative to its lower region 5*b*. Furthermore, at least one axial groove 5*c* is formed in the outer face of the outer tubular part 5.

The pouch 1 is secured in a leaktight manner to the ring 4, for example by ultrasonic welding, or by any other method of welding, of the neck 2 and of the flared rim 3 around the inner tubular part 6, of the central part 8 and under the collar 7 of the ring 4, up to the lower region 5*b* of the outer tubular part 5 of this ring 4.

FIG. 2 represents a rigid outer protective container 9, moulded in a single piece from plastic, of which the cylindrical body, which has a closed bottom 9*a*, opens towards the outside in a neck 10 which is also cylindrical, in extension of its body. In proximity to its upper end, the open neck 10 of the outer container 9, which is also referred to as the bottle, has an annular step 10*a* projecting radially inwards and separated by an annular hollow or recess 10*b* from an annular shoulder 10*c* projecting radially inwards and axially towards the bottom 9*a* of the bottle 9 relative to the step 10*a*. The dimensions of the step 10*a*, of the hollow 10*b* and of the shoulder 10*c* of the neck 10 of the bottle 9 and those of the projecting 5*a* and hollow 5*b* regions of the periphery of the ring 4 are such that the assembly constituted by the pouch 1 and the ring 4 can be introduced into the bottle 9 and fastened in the neck 10 of the latter by forcible elastic snap-fastening of the projection 5*a* of the ring 4 into the hollow 10*b* of the neck 10, between the step 10*a* and the shoulder 10*c* of this neck, as shown in FIG. 2.

The device also includes a manual pump 11, according to FIG. 3, for dispensing in individual metered amounts a product stored in the flexible pouch 1, without allowing outside air to enter this pouch 1, and the pump 11 comprises a body 12, which is fastened by forcible elastic snap-fastening on the ring 4, and plunger 13 which is mounted so as to move on the body 12 and is manually actuated by the user in order to dispense metered amounts of the product, the body 12 and the plunger 13 each being made of plastic. As also shown in FIG. 4, the body 12 comprises a central cylinder 14, open at its upper end and closed at its lower end by a bottom 15 pierced with feed orifices 16 around a tubular central core 17 of the bottom 15. At rest, the orifices 16 are closed by an intake valve 18, constituted by an annular elastic diaphragm bearing against the bottom 15, on the inside of the cylinder 14, and kept applied via its central part against the core 17 by a pin 19 with a widened head and a body forcibly inserted and elastically snap-fastened, or fixed and held in any other way, in the core 17.

Beyond the bottom 15, the cylinder 14 is extended substantially axially by a tubular part 20, surrounding the core 17 to which it is secured by radial stiffening ribs 20*a* and having, at its lower end, an annular step 20*b* projecting radially outwards for interacting with the step 6*a* projecting towards the inside of the ring 4, so as to allow forcible elastic snap-fastening of the body 12 on the ring 4 by fitting the tubular part 20 of the body 12 into the inner tubular part 6 of the ring 4 and forcible snap-fastening of the step 20*b* axially beyond and below the step 6*a*, towards the inside of the flexible pouch 1.

Leaktightness between the tubular part 20 of the pump body 12 and the ring 4 is ensured by a O-ring seal 21 mounted around the tubular part 20 and held axially between the step 20*b* and the outer axial ribs 20*c* on the side of the bottom 15. These outer ribs 20*c* of the tubular part 20 ensure that, when the pump 11 is mounted on the ring 4, the seal 21 remains between the tubular part 20 of the pump body 12 and the tubular part 6 of the ring 4, and can move axially over a limited travel between these two tubular parts, without interfering with the mechanical means for fastening the pump body 12 on the ring 4. The leaktightness ensured by the seal 21 has no effect on the fixing of the pump body 12 on the ring 4, and vice versa.

The assembly constituted by the cylinder 14, the bottom 15 with the core 17, and the tubular part 20 with the ribs 20*a* and 20*c* and the step 20*b* is moulded from plastic in a single inner piece.

The pump body 12 also comprises an outer piece moulded integrally from plastic and comprising an inner cylindrical jacket 22 which surrounds the cylinder 14, an outer cylindrical jacket 23 which surrounds the inner jacket 22 with radial separation so as to define between them an annular chamber 24 which is closed, on the side of the tubular part 22, by an annular bottom 25 joining the two jackets 22 and 23 by their lower ends, and finally an outer skirt 26 which surrounds the outer jacket 23 with radial separation and which is secured to the latter, on the one hand by a radial annular collar 27 joining them by their upper ends, and on the other hand by radial stiffening ribs 26*a*.

The upper end of the inner jacket 22 is secured to a radial annular bottom 28, projecting inwards to a small axial distance beyond the upper end of the cylinder 14, and the central passage of the annular bottom 28 is delimited by an axial tubular collar 29 for guiding a piston rod, as described below.

The lower end of the inner jacket 22, which is flared radially outwards and towards the bottom 25 of the chamber 24, is axially extended beyond the bottom 25 by a tubular tip 30 which is provided, at its lower end, with a step 31 projecting radially inwards. This tip 30 and this step 31 interact with an outwards radial projection 14*a* on the lower end of the cylinder 14, around the bottom 15, to allow forcible elastic snap-fastening of the inner piece consisting of the cylinder 14, the bottom 15, the core 17 and the tubular part 20, inside the outer piece of the pump body 12, this outer piece consisting of the jackets 22 and 23, the bottoms 25 and 28, the skirt 26 and the collars 27 and 29, as well as the tip 30 and the step 31. As shown by FIG. 4, when the two pieces of the pump body 12 are in this position, snap-fastened into one another, an axial channel 32 of short radial width is left between the outer wall of the cylinder 14 and the inner wall of the inner jacket 22, and this channel 32 opens out, at its upper end, between the upper end of the cylinder 14 and the annular bottom 28, and at its lower end, by virtue of at least one axial groove 14*b* formed in the radial projection 14*a* of the lower end of the cylinder 14, in an annular chamber 33 which is delimited, on the one hand, between the tubular part 20 of the pump body 12, above the gasket 21, and the tubular part 6 and the chamfer of the annular rib 8*c* of the ring 4, and, on the other hand, between the tip 30 of the pump body 12 and the cylindro-conical central part 8 of the ring 4, the step 31 at the lower end of the tubular tip 30 not being in contact with the rib 8*c*, because of the limitation where the pump body 12 enters the ring 4 by the contact between the bottom 25 of the annular chamber 24 of the pump body 12 against the stop ribs 8*d* of the ring 4, as shown by FIG. 4.

Similarly, this annular chamber 33 communicates freely with the annular chamber 34 delimited between the outer jacket 23 and the skirt 26 and the neck 10 of the bottle 9, in which this skirt 26 is axially fitted elastically when the pump body 12 is mounted on the ring 4, without leaktight contact of the lower end part of the outer jacket 23 with the cylindrical part 8*a* of the ring 4.

In turn, this annular chamber 34 is in permanent communication with the volume 35 delimited between the two containers 1 and 9, by virtue of the axial passage formed by the axial groove 5*c* in the parts 5*a* and 5*b* of the tubular periphery 5 of the ring 4 making it snap-fasten elastically into the neck 10 of the bottle 9.

A pumping and metering chamber 36 is delimited in the cylinder 14, between its bottom 15 and the intake valve 18, at its lower end, and, towards its upper end, an annular piston 37 mounted so as to slide in a leaktight manner in the cylinder 14 by virtue of a O-ring seal 38 accommodated in a peripheral groove of the piston 37. Towards the outside of the cylinder 14, the piston 37 is extended by a shaft 39 which passes through the axial tubular collar 29 of the annular bottom 28 of the inner jacket 22 and is mounted so as to slide in this collar 29, not in a leaktight manner. The central passage of the annular piston 37 accommodates an outlet valve 40 secured to a tubular rod 41 mounted so as to slide in a leaktight manner in the shaft 39 of the piston 37 by virtue of a O-ring seal 42 held in a groove at its periphery, and on its face lying towards its rod 41, the valve 40 bears an annular seal 43 facing an annular radial shoulder 37*a* connecting the annular piston 37 to its shaft 39. Between the seals 42 and 43, the tubular rod 41 is pierced by radial orifices 44.

The plunger 13 of the pump 11 comprises a dispensing tube 45 in two parts which are substantially perpendicular to one another, one 45*a* of which is radial at the upper end of the plunger 13, and the other 45*b* of which is axial and central and engaged in the shaft 39 so that it can slide in the latter over an axial travel limited by the abutment of the upper end 39*a* of this shaft 39 against the upper part of the plunger 13 and the radial part 45*a* of its dispensing tube 45. At the same time, the tubular rod 41 is engaged axially inside the axial part 45*b* of the dispensing tube 45, until it abuts via its upper end 41*a* against an inner radial shoulder 45*c* of this axial part 45*b*, and in such a way that the tubular rod 41 is secured to this axial part 45*b* by forcible elastic snap-fastening of a step 41*b* projecting radially outwards on the rod 41 and accommodated in a circular groove of corresponding shape of the inner wall of the tubular axial part 45*b*, as shown in FIG. 4. Thus, the tubular rod 41 and the outlet valve 40 are linked to the axial movements of the plunger 13 relative to the pump body 12, for actuating the pump 11 by the user pressing the plunger 13 towards the pump body 12 and the containers 1 and 9. To this end, the plunger 13 includes an outer skirt 46, which surrounds, with radial separation, the central axial part 45*b* of the plunger 13 as well as the shaft 39 and the tubular rod 41, in such a way that the lower end of the skirt 46 is fitted in, not in a leaktight manner, and can slide in the annular chamber 24 between the two tubular jackets 22 and 23 of the pump body 12. This skirt 46, guided axially in the annular chamber 24 during the axial movements of the plunger 13 relative to the pump body 12, surrounds, accommodates and protects the upper end part of a compression coil spring 47 which bears via its upper end against inner ribs 46*a* of the skirt 46, while the lower end part of the spring 47 is accommodated in the annular chamber 24 and bears via its lower end against axial ribs 22*a* projecting on the lower end of the inner jacket 22 and towards the inside of the annular chamber 24.

The spring 47 returns the plunger 13, the outlet valve 40 and the piston 37 to the rest position, in which the plunger 13 is axially displaced to the greatest extent in the direction separating it from the pump body 12, and in which the outlet valve 40 is closed because it bears in a leaktight manner via its annular seal 43 against the shoulder 37*a* of the piston 37, the latter being itself in abutment via its annular part 37*b*, projecting on its face lying towards the annular bottom 28, against this bottom 28, which thus constitutes a leaktight closure seat for the axial channel 32 between the cylinder 14 and the jacket 22, to cut off the intake of outside air into this channel 32. In fact, the outside air can penetrate freely into the annular chamber 24, by passing between the skirt 46 of the plunger 13 and the outer jacket 23 of the pump body 12, then pass from the chamber 24 into the annular chamber 48, between the skirt 46 and the shaft 39, then between the shaft 39 and the tubular collar 29 and the annular bottom 28, as far as the air intake valve formed by the annular part 37*b* of the piston 37, which is closed when this part 37*b* is in abutment against the bottom 28, in the initial or rest position in FIG. 4. In this figure, the circuit for intake of outside air to the annular part 37*b* of the piston 37, then from this part 37*b* into the volume 35 between the two containers 1 and 9, is indicated by arrows and a broken line. As explained above, this air intake circuit is closed when the pump 11 is at rest.

Starting from this rest position in FIG. 4, and assuming that the flexible pouch 1 is filled with a product to be dispensed, if the user presses on the plunger 13, he firstly moves the plunger 13 and the central tubular part 45*b* of the dispensing tube with the tubular rod 41 and the valve 40, relative to the pump body 12 and the piston 37. The valve 40 is no longer in leaktight contact with the piston 37 via the gasket 43. The chamber 36 is thus in communication through the radial orifices 44 with the interior of the tubular rod 41, and therefore with the outside via the dispensing tube 45. Then, after contact between the shaft 39 and the plunger 13, as the latter is depressed, the plunger 13 moves with it the shaft 39 and the piston 37, which is moved in the cylinder 14 towards its bottom 15. The air initially in the chamber 36 is expelled and the volume of this chamber 36 is reduced. As soon as the piston 37 is moved in the cylinder 14, its annular part 37b is separated from the annular bottom 28, so that the outside air circuit is open, and air can pass from the outside of the pump into the volume 35 between the two containers 1 and 9, via the air intake circuit described above.

When the plunger 13 is released, the return spring 47, compressed during the depression phase, expands and returns upwards the plunger 13 and the valve 40, which is closed in a leaktight manner against the piston 37, which is then returned upwards by the valve 40 pulled by the plunger 13. A pressure reduction is thus created in the chamber 36, while the volume 35 between the two containers 1 and 2 remains supplied with outside air, for as long as the annular part 37*b* of the piston 37 has not returned to abut against the annular bottom 28. Under the effect of this pressure reduction, suction is produced which elastically flexes the diaphragm 18 of the intake valve towards the inside of the chamber 36, and uncovers the orifices 16 and allows the product in the pouch 1 to enter the chamber 36, which is thus filled with a metered amount of product to be dispensed. The pressure reduction which results therefrom in the flexible pouch 1 is compensated for by the contraction of this pouch 1 by the outside air admitted into the intermediate volume 35.

Once the chamber 36 has been filled with product, a second operation on the plunger 13 produces, as described above, opening of the valve 40 and therefore connection of the chamber 36 to the dispensing tube 45, then movement of the piston 37 in the cylinder 14, which expels the product contained in the pumping and metering chamber 36 because the intake valve 18 remains closed as a result of the overpressure in the chamber 36. After the chamber 36 has been emptied, releasing the plunger 37 leads, through the effect of the return spring 47 and as described above, to closure of the outlet valve 40, the return of the piston 37 to the initial position and opening of the intake valve 18, in order to admit a new metered amount of product into the chamber 36.

Figure 7:
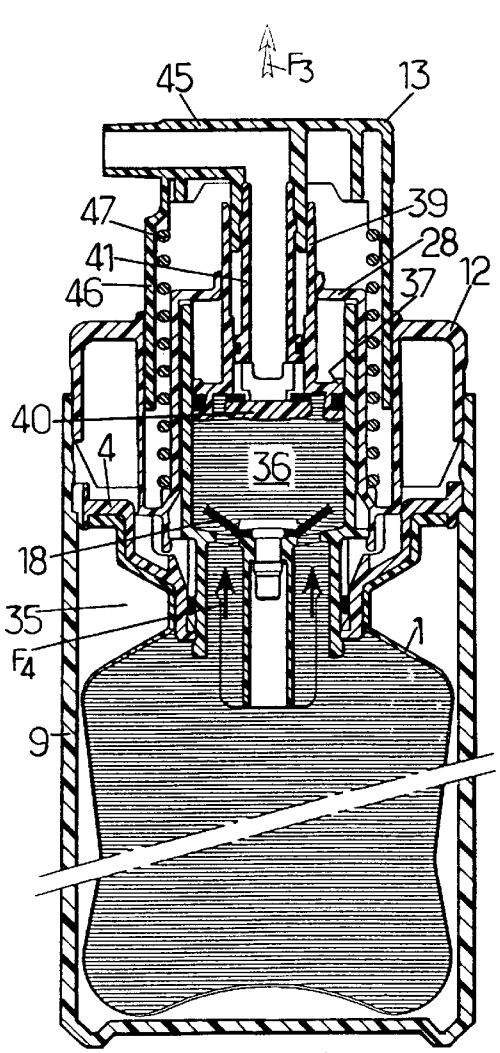
Figure 6:
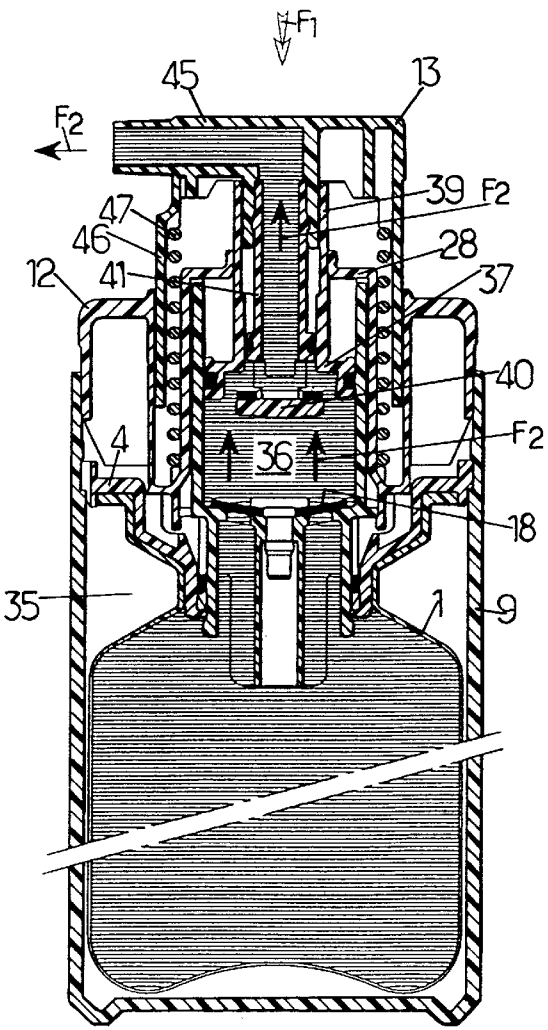
Figure 5:
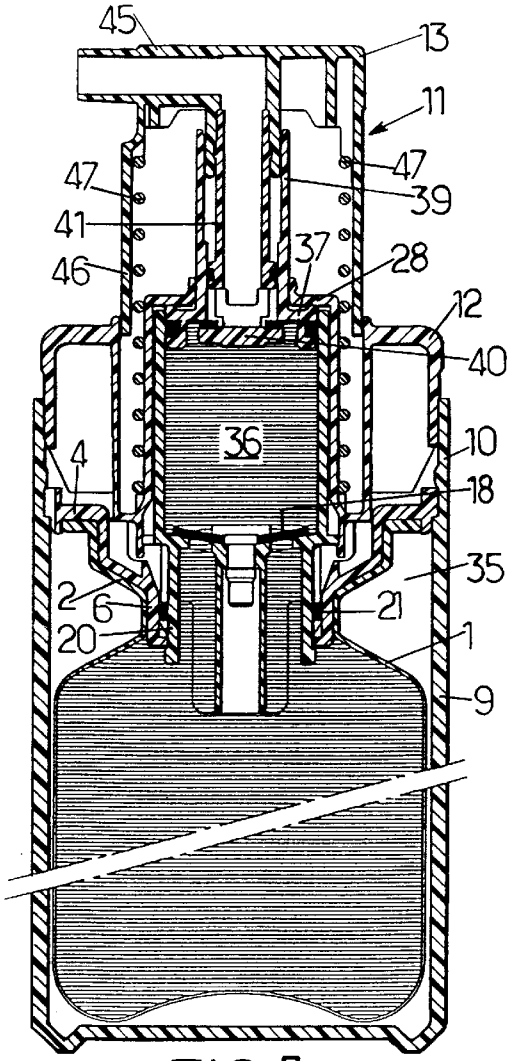

These various phases in the operation of the pump are represented in FIGS. 5 to 7.

FIG. 5 represents the dispenser with its pump 11 at rest, after at least one operation of the plunger 13, so that the chamber 36 contains a metered amount of product. The two valves 18 and 40 are closed, as is the circuit for intake of air into the intermediate volume 35, via the annular part 37*b* of the piston 37 abutting against the annular bottom 28 of the inner jacket 22.

FIG. 6 represents the dispenser during dispensing of a metered amount of product, the plunger 13 being depressed by a manual action by the user, indicated by the arrow F1, the outlet valve 40 being open and the intake valve 18 closed, the piston 37 being inserted into the cylinder 14, so that the product in the chamber 36 is expelled through the dispensing tube 45, as indicated by the arrows F2.

In FIG. 7, on release of the plunger 13, the spring 47 pushes the latter in the direction of the arrow F3, which closes the outlet valve 40 and, through suction, opens the intake valve 18, so that product moving in the direction of the arrows F4 passes from inside the flexible pouch 1 into the chamber 36, which it fills.

Of course, the flexible pouch 1 of the assembly in FIG. 2 is filled with product before fitting the pump in FIG. 3 onto the assembly in FIG. 2 by elastic snap-fastening of the pump body 12 by its tubular part 20 into the inner tubular part 6 of the ring 4 of this assembly. This snap-fastening is ensured by the step 20*b* passing axially beyond the step 6*a*, leaktightness being ensured by the seal 21 between the pump body 12 and the ring 4.

Between two uses of the device, or during storage of the product in this device before it is used, it is possible for a degree of evaporation of a volatile phase of the product, or even a degree of migration of a part of the product, to take place through the thin wall of the body of the flexible pouch 1. This evaporation and/or migration, due to the permeability of the thin plastic constituting this wall, leads to an accumulation of vapour and/or gas, or even of product, in the volume 35 between the containers 1 and 9, and causes a pressure increase therein. These gases and/or vapours tend to follow the opposite path from the one followed by the outside air, when a pressure reduction is created in this same volume 35. This reverse route is closed off by the leaktight bearing of the annular part 37*b* of the piston 37 in abutment against the annular bottom 28 of the inner jacket 32, as is always the case between two uses or before use of the device. The annular part 37*b* of the piston 37 and the annular bottom 28 of the inner jacket 22 thus constitute confinement means for the gases and/or vapours which might accumulate in the volume 35 between the containers 1 and 9, since this volume is no longer in permanent communication with the outside of pump 11, because of the presence of these confinement means on the air intake route, which confinement means nevertheless allow outside air to enter this intermediate volume 35 as soon as the pump 11 is actuated, in order to compensate for the pressure reduction created in this volume 35 by the operation of the pump 11.

This produces a packaging and dispensing device in which the permeability of the wall of the deformable container 1 no longer poses any problem, since the migration and/or evaporation of a part of the product contained in this deformable container 1 is prevented when saturation is reached in the intermediate volume 35 between the two containers 1 and 9.

If it is feared that a gas, such as oxygen, or a vapour, such as water vapour, present in the air contained in the volume 35, outside the deformable container 1, may diffuse through the thin wall of this container 1 and present a risk of oxidation or moistening of the product contained therein, a simple remedy to this problem consists in introducing into the volume 35, when fitting the assembly constituted by the flexible pouch 1 and the ring 4 into the rigid bottle 9, a material or chemical substance capable of binding or absorbing this gas or this vapour.

As a variant, if it is not essential to provide an air circuit preventing evaporation of the product contained in the flexible pouch 1, the cylinder 14 and the inner jacket 22 may constitute one and the same piece, without an axial air channel 32, and the volume 35 between the two containers 1 and 9 may be connected to the atmosphere through an air intake provided by a hole in the bottom of the container 9, or else by a hole in the outer jacket 23 or in the part of the skirt 26 which is not fitted into the neck 10 of the container 9.

I claim:

1. A device for packaging and dispensing a product comprising:

a rigid outer container with an open neck, a deformable inner container with an open neck, said inner container being essentially accommodated inside the outer container and intended to contain a product to be packaged and dispensed, and a manual pump, of the type without air intake into the inner container, said pump being intended to dispense the product in individual metered amounts and being mounted in a leaktight manner on the neck of the inner container with the aid of leaktight means, wherein the pump includes a body having a tubular part which is surrounded by said leaktight means and is engaged in a leaktight manner in the neck of the inner container, for feeding the pump with product from the inner container, and the neck of the inner container is secured in a leaktight manner to a rigid annular ring, provided, at its outer periphery, with first fastening means, which interact with complementary fastening means of the neck of the outer container, for fastening the inner container and the ring on the outer container and, at its inner periphery, with second fastening means, which interact with complementary fastening means of the pump body, for fastening the pump to the ring, said tubular part of said pump body being engaged in said ring and said leaktight means comprising at least one annular gasket, mounted between said ring and said tubular part of the pump body while being separated from said second fastening means of the ring and from said complementary fastening means of said pump body.

2. A device according to claim 1, wherein said first and second fastening means of the ring and said complementary fastening means of the neck of the outer container and of the pump body are removable elastic snap-fastening means, with outer radial projections moved axially beyond facing inner radial projections in order to fix the ring on the outer container and the pump body on the ring.

3. A device according to claim 1, wherein said ring comprises, at its inner periphery, an inner tubular part which has said second fastening means and in which said tubular part of the pump body is engaged, which tubular part has said complementary fastening means, said annular gasket being mounted between said inner tubular part of the ring and said tubular part of the pump body.

4. A device according to claim 1, wherein said ring comprises, at its outer periphery, an outer tubular part which has said first fastening means and is engaged in said neck of the outer container, the complementary fastening means of which are provided with projections and/or hollows having complementary shapes for coupling to said first fastening means of the ring, in order to allow the ring to be attached onto the neck of the outer container after the inner container and the ring have been introduced into said outer container.

5. A device according to claim 1, wherein the outer container has a closed bottom and at least one of said ring and said necks defines at least partially, outside said leaktight means, at least a first passage for air intake into the volume defined between the two containers, and the body of the pump has, also outside said leaktight means, at least a second passage for air intake into said volume between the containers, so that said first and second passages for air intake define in succession a conduit permitting the intake of external air into the volume between the containers, at least when the pump is actuated, and the device also comprises means for confining any part of the product passing through the deformable wall of the inner container from the interior of the latter towards the volume between the containers, and tending to escape towards the outside via the conduit for air intake, at least when the pump is not actuated.

6. A device according to claim 5, wherein said first passage for air intake is formed, between the outer periphery of the ring and the neck of the outer container, by said first fastening means of the ring and said complementary fastening means of the neck of the outer container, and with the aid of at least one recess formed in said ring and/or in said neck of the outer container.

7. A device according to claim 5, wherein the pump is of the type comprising a piston, applied against a stop of the body of the pump by the action of means for elastic return to the rest position of the pump and separated from the stop against the elastic return means by manual pressure on a plunger when the pump is actuated, and wherein that said passages for air intake are in permanent communication with one another, and the confinement means comprise said stop which has an annular part, forming a leaktight seat, in contact with an annular part of the piston and which allows air to pass from the outside of the device towards said passages for air intake as soon as said annular part of the piston is separated from said annular part of the stop by manual pressure on said plunger.

8. A device according to claim 7, wherein said stop of the pump body is secured to a tubular inner jacket of the pump body and projects towards the interior of said inner jacket which surrounds a cylinder of the pump body in which said piston is mounted so as to slide in a leaktight manner, said second passage for air intake comprising at least one channel delimited between, on the one hand, said cylinder and, on the other hand, said inner jacket and said stop, one end of said channel opening towards the outside of said pump body, between said stop and said piston, as soon as the piston is separated from the stop by manual pressure on the plunger, while the other end of said channel permanently opens into an annular space delimited between the pump body and the ring, and itself in permanent communication with said first passage for air intake.

9. A device according to claim 8, wherein the pump body comprises an outer tubular jacket, surrounding said cylinder and inner jacket and delimiting with them, on the pump body, an annular chamber for accommodating and supporting an end part of at least one coil spring for compressing said elastic return means, the other end part of said spring being accommodated inside a first tubular skirt, secured to the pump plunger and having its free end engaged in said annular chamber of the pump body, said outer jacket being itself surrounded by a second tubular skirt, secured to the pump body and fitted into the neck of the outer container.

10. A device according to claim 8, wherein said tubular part of the pump body substantially extends the cylinder of said body and is secured to a bottom at one end of the cylinder which is turned towards the inner container, said bottom being pierced by at least one orifice for filling the cylinder with product originating from the inner container and supporting at least one valve for intake into the pump, which valve is intended selectively to close and release said filling orifice, said piston of the pump being annular and extended, beyond the other end of the cylinder of the body, by a shaft which is mounted so as to slide in said annular stop of the body and in which a dispensing tube of said plunger is mounted so as to slide over a limited travel, said tube being linked in translation with a tubular rod, of which said tube extends a central channel and which slides in a leaktight manner in said shaft and is closed, in the annular piston, by a valve for outlet from the pump, which valve is applied in a leaktight manner against the annular piston by the action of the elastic return means and is separated from the piston by acting on the plunger, in order to allow outlet of the product between the piston and the outlet valve, from the inside of the cylinder towards the inside of the tubular rod, via at least one radial orifice of the rod.

11. A device according to claim 1, wherein the volume between the containers contains at least one chemical substance capable of binding a gas and/or a vapour contained in the outside air admitted into this volume, in order to prevent it from diffusing through the wall of the inner container and towards the internal volume of the latter.

* * * * *